US006116727A

United States Patent [19]

Hagiwara

[11] Patent Number: 6,116,727

[45] Date of Patent: Sep. 12, 2000

[54] INK SUPPLY MECHANISM

[75] Inventor: Yoshihiro Hagiwara, Niigata, Japan

[73] Assignee: NEC Corporation, Tokyo, Japan

[21] Appl. No.: 09/376,807

[22] Filed: Aug. 18, 1999

[30] Foreign Application Priority Data

Aug. 19, 1998 [JP] Japan ..... 10-247755

[51] Int. Cl.[7] ..... B41J 2/175; B41J 2/185; B41J 2/18

[52] U.S. Cl. ..... 347/89

[58] Field of Search ..... 347/89, 85, 90, 347/92, 94

[56] References Cited

U.S. PATENT DOCUMENTS 5,956,062 9/1999 Omata et al. ..... 347/89

FOREIGN PATENT DOCUMENTS 61-112648 5/1986 Japan .
7-76105 3/1995 Japan .
10-67111 3/1998 Japan .
10-128980 5/1998 Japan .
10-157134 6/1998 Japan .
10-181025 7/1998 Japan .

OTHER PUBLICATIONS

Japanese Office Action issued in a related application.
English translation of Japanese Office Action.

*Primary Examiner*—Huan Tran
*Attorney, Agent, or Firm*—Ostrolenk, Faber, Gerb & Soffen, LLP

[57] ABSTRACT

The present invention provides an ink supply mechanism for use in an electrostatic ink jet recording apparatus having a stable recording quality by maintaining a predetermined amount and a predetermined pressure of ink in the discharge section. The ink supply mechanism includes: a printing head 11 having an ink discharge section; an ink tank 10; an ink flow-in pipe path 30 provided between the printing head and the ink tank, and having a flow-in pump for supplying ink from the ink tank to the printing head; and an ink flow-out pipe path 31 having a flow-out pump for recovering the ink from the printing head to the ink tank.

12 Claims, 2 Drawing Sheets

INK SUPPLY MECHANISM

BACKGROUND OF THE INVENTION

1. Field of the Invention

The present invention relates to an ink supply mechanism in an electrostatic ink jet recording apparatus and in particular, to an ink supply mechanism for use in a serial type electrostatic ink jet recording apparatus.

2. Description of the Related Art

For example, Japanese Patent Publication (unexamined) A7-76105 discloses an ink chamber pressure regulating means for use in an ink jet recording apparatus using a liquid ink as a recording material.

This ink chamber pressure regulating means includes a pressure regulating valve having a slit in an elastic member. When the pressure difference between the inside and the outside of the ink tank increases, the elastic member is greatly deformed to open the slit so that the interior of the ink tank communicates with the atmospheric air so that the pressure in the ink tank increases up to the atmospheric pressure, thus regulating the pressure in the ink tank.

Moreover, Japanese Patent Publication (unexamined) A61-112648 discloses a printing head including a pressure regulating path pipe having a first end communicating with the ink changer and a second end closed. A pressure change in the ink chamber is absorbed by a volume change of a closed air layer.

However, the aforementioned devices have various problems as follows.

The first problem is efficiency of absorbing the pressure fluctuation.

The pressure regulating device should rapidly absorb a shock type pressure change when one has occurred, so as to maintain a predetermined inner pressure of the ink chamber. The shock type pressure is caused by high-speed ink movement in the ink chamber in the main scan direction (first reason) or by a pressure fluctuation generated from an ink circulation member such as a pump (second reason). In the aforementioned configuration having a closed air chamber, it is difficult to sufficiently absorb the pressure fluctuation caused by the second reason.

This is because the ink chamber communicates with the ink circulator and a pressure wave is transferred in the fluid.

That is, in order to effectively absorb these pressure fluctuations, it is preferable that the ink in the ink chamber be disconnected as a fluid from the ink in the ink circulator.

The second problem is that these pressure regulating means are intended for the ink almost in a still state. Most of the conventional ink jet printers do not need an ink circulation, and for the ink discharged from a nozzle, a new ink is added by the capillary effect or mechanical force. These methods can perform pressure adjustment. However, in an ink jet printer of serial type in which the ink continuously circulates, it is difficult to maintain a predetermined pressure, and ink circulation may be disturbed.

SUMMARY OF THE INVENTION

It is therefore an object of the present invention to provide an ink supply mechanism in an electrostatic ink jet recording apparatus, which mechanism enables to maintain a constant discharge ink amount under a constant pressure, thus improving the recording quality.

The ink supply mechanism according to the present invention includes: a printing head having an ink discharge section; an ink tank; an ink flow-in pipe path 30 provided between the printing head and the ink tank, and having a flow-in pump for supplying ink from the ink tank to the printing head; and an ink flow-out pipe path 31 having a flow-out pump for recovering the ink from the printing head to the ink tank.

DESCRIPTION OF THE PREFERRED EMBODIMENTS

Figure 1:
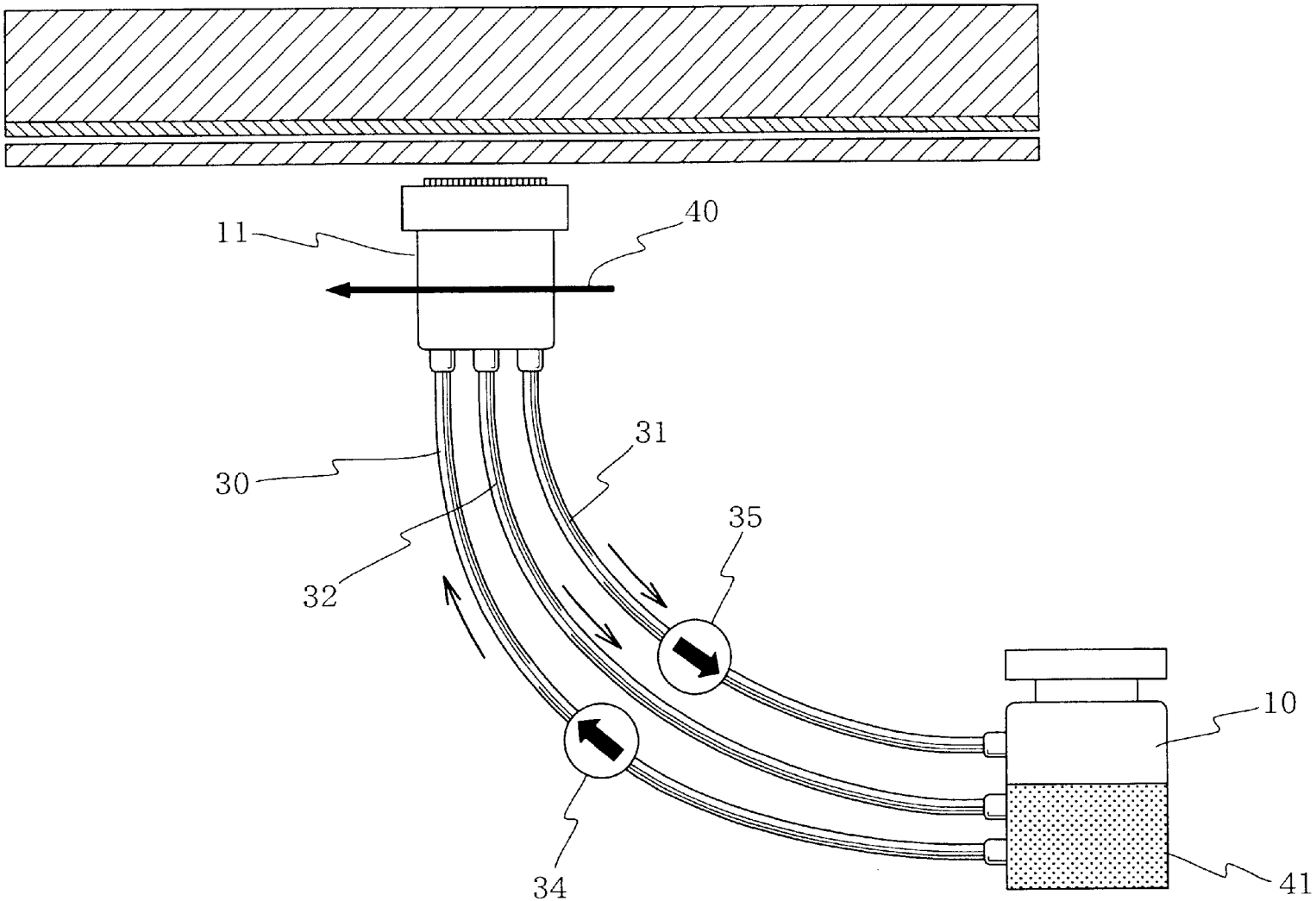
FIG. 1 schematically shows an ink supply mechanism according to an embodiment of the present invention.

FIG. 1 schematically shows an ink circulation system of the electrostatic ink jet recording apparatus according to the present invention.

As shown in FIG. 1, an ink tank 10 is connected to a printing head block 11 (hereinafter, referred to as the head block) via at least three pipe paths.

One of the three paths is an ink flow-in pipe 30 through which an ink 41 flows from the ink tank 10 to the head block 11 and which is provided with a flow-in quantitative pump 34.

Another path is an ink flow-out pipe through which the ink 41 is flows out from the head block 11 to the ink tank 10 and which is provided with a flow-out quantitative pump 35.

Moreover, in the present embodiment, there is provided an ink return pipe 32 connecting the head block 11 to the ink tank 10 so that an excessive portion of the ink 41 can drop into the ink tank 11 by the gravitational force.

Figure 2:
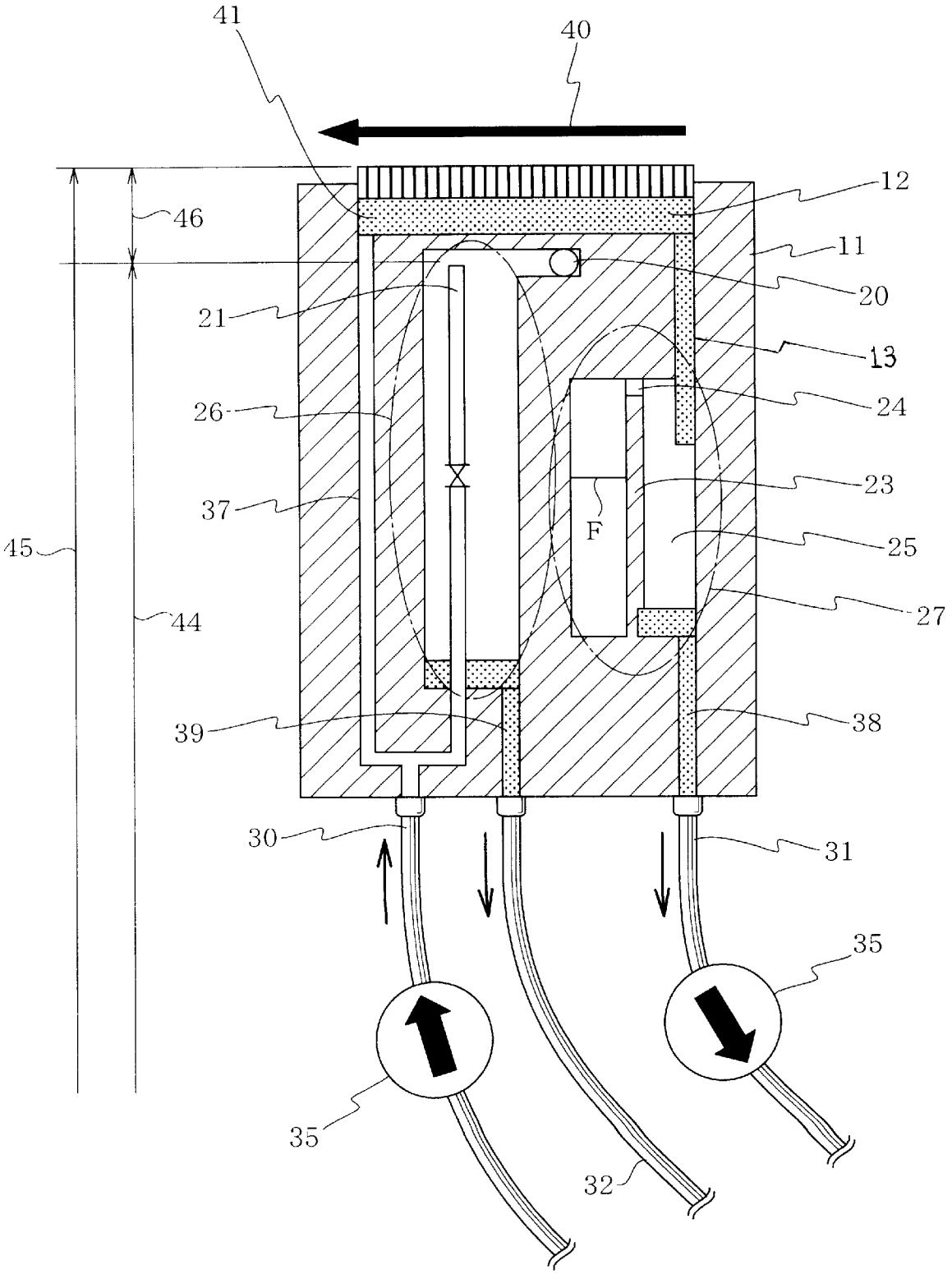
FIG. 2 is an enlarged cross sectional view of a printing head according to the embodiment of the present invention.

FIG. 2 is a cross sectional view of the head block 11.

The ink flow-in pipe 30 is connected to an ink flow-in path 37 formed in the head block 11. The ink flow-in path is branched to paths: one of them (hereinafter, referred to as a first branch) leads to the ink chamber 12 and the other (hereinafter, referred to as a second branch) leads to a flow-in regulating section 26.

This flow-in pressure regulating section 26 is provided below an ink discharge section 13 (hereinafter, referred to as the discharge section). The flow-in pressure regulating section includes an atmospheric opening 20 at its top and a space having an ink return path 39 at its bottom. The ink flow-in path 21 branched from the ink flow-in pipe 30 protrudes upward into the space of the flow-in pressure regulating section 26 and the upper end is open.

The ink 41 in the ink chamber 12 goes to the ink flow-out pipe via an ink flow-out path 38 in the head block 11.

Moreover, the ink flow-out path 38 includes a flow-out pressure regulating section 27 having an air chamber 25 formed in the head block 11. This air chamber 25 has a partition 23 to divide the air chamber 25 into a space for the ink 41 and a space having an elastic film F. These spaces communicate with each other through a small hole 24 formed in the partition 23.

The elastic film F has a surface parallel to the paper feed direction 40 which is vertical to the movements of the head block 11.

Description will now be directed to the operation of the present embodiment with reference to FIG. 1 and FIG. 2.

The ink 41 flowing from the ink flow-in pipe 30 into the head block 11 is branched into the two branches within the head block 11. Through the first branch, the ink 41 flows into the ink chamber 12 via the ink flow-in path 37. Through the second branch, the ink 41 flows into the flow-in pressure regulating section 26. The ink which has flown into the ink chamber 12 flows through the ink discharge section 13 forming a free surface exposed to the atmospheric air, and goes into the flow-out pressure regulating section 27 and then into the ink flow-out pipe 31 and returns into the ink tank 10.

The ink flow-out and flow-in are both forced by the quantitative pumps, so that a predetermined amount of the ink 41 flows constantly at the tip end of the printing head. Actually, however, the consumption of the ink 41 for printing operation, cleaning operation, and leak is not constant and the pump performance may not be constant. Accordingly, a necessary flow-in amount and a necessary flow-out amount are not always constant, and it is difficult to maintain a constant amount of the ink 41 in the ink chamber 12. What can be done is to define the flow-in ink amount sufficiently greater than the flow-out ink amount and to make the pipe path resistance into the flow-in pressure regulating section 26 sufficiently smaller than the pipe path resistance into the ink chamber 12.

Moreover, the head of the ink flowing into the flow-in pressure regulating section 26 is adjusted to be lower than the discharge section by 5 to 10 mm.

Thus, the ink 41 which has flown into the head block 11 is branched into the flow-in pressure regulating section 26 and begins to circulate through the ink return pipe 32.

Here, in the second branch, i.e., the flow-in path 37, the ink 41 comes up to the vicinity of the ink chamber 12 by the liquid pressure and stops at the height 44 where the ink flows into the flow-in pressure regulating section 26.

Next, when the flow into the flow-in pressure regulating section 26 is closed by an electromagnetic valve or the like, the ink flows into the ink chamber 12 and ink circulation starts within the ink flow-out pipe 31. Immediately after this, the flow into the flow-in pressure regulating section 26 is opened. Thus, the ink 41 returns into the ink flow-out returns to the ink tank 10 through the ink flow-out pipe 31 and the ink return pipe 32. The ink inner pressure at the tip end of the discharge section 13 is maintained under a negative pressure corresponding to the difference between the head 44 where the ink flows into the flow-in pressure regulating section 26 and the ink head 46 at the discharge section.

The amount of the ink 41 coming from the ink chamber 12 is fixed by the performance of the flow-out pump 34 and an excessive portion of the ink 41 is recovered by the ink return pipe 32. Thus, it is possible to create a stationary state, i.e., to maintain a constant amount of the ink at the tip end of the discharge section while the ink is circulating under a constant pressure.

In this stationary state, a vibration may be caused by situations as follows.

(1) pressure fluctuation during a spacing operation caused by an external shock such as operation of the ink flow-in pipe 30 or the ink-flow-out pipe 31

(2) Pressure fluctuation during a spacing operation caused by an inertia of the ink flow-in pipe 30 or the ink-flow-out pipe 31 itself.

(3) Pressure fluctuation during a spacing operation caused by the inertia of the ink 41 itself in the head block 11.

(4) Mechanical vibration during operation of the flow-in pump 34 or the flow-out pump 35.

Among these reasons, the (1) is considered to have the greatest affect. In the present embodiment, the ink flow-in pipe 30 and the ink flow-out pipe 31 are directly connected to the flow-in pump 35 and the flow-out pump 35, respectively. Accordingly, the ink flow is maintained constant at the end connected to the pumps and no flow fluctuation is caused by pressure fluctuation by spacing.

The (2), (3), and (4) are considered to have comparatively small vibrations, which are all absorbed in the flow-in pressure regulating section 26 when passing through the air chamber open to the atmosphere. Moreover, in the flow-out pressure regulating section 27, pressure fluctuations are absorbed in the pressure drop and air volume change by deformation of the elastic film F in the closed air chamber 25.

According to the embodiment of the present invention, the ink flow-in pipe and the ink flow-out pipe are directly connected to the flow-in pump and the flow-out pump so that the ink flow is made constant at the ends where the pumps are attached, thus preventing the pressure fluctuation during a spacing operation.

Moreover, the pressure fluctuation during a movement in the main scan direction is effectively attenuated in the pressure regulating section. This stabilizes the ink meniscus at the discharge section.

Thus, it is possible to improve the recording quality in a serial printer.

Furthermore, the pressure adjustment can be realized only by the pipe layout in the small head block in combination with the air chamber and the elastic film. This enables to effectively attenuate the pressure fluctuation by using a small mechanism.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-247755 (Filed on Aug. 19$^{th}$, 1998) including specification, claims, drawings and summary are incorporated herein by reference in its entirety.

What is claimed is:

1. An ink supply mechanism for use in an electrostatic ink jet recording apparatus, the mechanism comprising:

a printing head having an ink discharge section;

an ink tank for supplying ink to the printing head;

an ink flow-in pipe path provided between the printing head and the ink tank;

a flow-in pump connected to the ink flow-in pipe for supplying ink from the ink tank to the printing head;

means for absorbing any pressure fluctuations of the ink supplied to the printing head;

an ink flow-out pipe path provided between the printing head and the ink tank; and a flow-out pump connected to the ink flow-in pipe for recovering the ink from the printing head to the ink tank.

2. An ink supply mechanism for use in an electrostatic ink jet recording apparatus, the mechanism comprising:

a printing head having an ink discharge section;

an ink tank for supplying ink to the printing head;

an ink flow-in pipe path provided between the printing head and the ink tank;

a flow-in pump connected to the ink flow-in pipe for supplying ink from the ink tank to the printing head;

an ink flow-out pipe path provided between the printing head and the ink tank;

a flow-out pump connected to the ink flow-in pipe for recovering the ink from the printing head to the ink tank; and a flow-in pressure regulating section provided as a branch of the ink flow-in pipe path, for absorbing the pressure fluctuation of the ink supplied to the printing head.

3. An ink supply mechanism as claimed in claim 2, wherein the flow-in pressure regulating section includes: an ink flow-in path branched from the ink flow-in pipe path; and a void section communicating with this ink flow-in path and having an opening to the atmosphere.

4. An ink supply mechanism as claimed in claim 3, the mechanism further comprising an ink return pipe path arranged adjacent to the void space of the flow-in pressure regulating section, so that the ink which has flown into this void section returns into the ink tank by its weight.

5. An ink supply mechanism as claimed in claim 3, wherein the flow-in pressure regulating section is arranged below the ink discharge section; there is provided the opening to the atmosphere above the void section; the ink return pipe path is arranged below the void space; and the ink flow-in path is branched from the ink flow-in pipe path and opens in the vicinity of the upper end.

6. An ink supply mechanism as claimed in claim 4, wherein the low-in pressure regulating section is arranged below the ink discharge section; the atmospheric opening is arranged above the void space; the ink return pipe path is arranged below the void space; the ink flow-in path is branched from the ink flow-in pipe path and arranged in the vicinity of the upper end of the void space.

7. An ink supply mechanism as claimed in claim 5, wherein the ink flow-in path has a predetermined valve to close and open the flow-in path.

8. An ink supply mechanism as claimed in claim 6, wherein the ink flow-in path has a predetermined valve to close and open the flow-in path.

9. An ink supply mechanism for use in an electrostatic ink jet recording apparatus, the mechanism comprising:

a printing head having an ink discharge section;

an ink tank for supplying ink to the printing head;

an ink flow-in pipe path provided between the printing head and the ink tank;

a flow-in pump connected to the ink flow-in pipe for supplying ink from the ink tank to the printing head;

an ink flow-out pipe path provided between the printing head and the ink tank; and a flow-out pump connected to the ink flow-in pipe for recovering the ink from the printing head to the ink tank;

wherein the printing head includes a flow-out pressure regulating section communicating with the ink discharge section and the ink flow-out pipe path, so as to absorb the ink pressure fluctuation of the ink to be returned to the ink flow-out pipe path.

10. An ink supply mechanism as claimed in claim 9, wherein the flow-out pressure regulating section is made to communicate with the ink discharge section and with the ink flow-out pipe path and have a void space for holding the ink in the ink discharge section and the ink flow-out pipe path in a discontinuous state.

11. An ink supply mechanism as claimed in claim 11, wherein the void space has a partition to divide the void space into two portions and the partition has a small hole for communicating between these two portions, so that one of the portions is used as a flow path of the ink and the other portion has an elastic film.

12. An ink supply mechanism for use in an electrostatic ink jet recording apparatus, the mechanism comprising:

a printing head having an ink discharge section;

an ink tank for supplying ink to the printing head;

an ink flow-in pipe path provided between the printing head and the ink tank;

a flow-in pump connected to the ink flow-in pipe for supplying ink from the ink tank to the printing head;

means for absorbing any pressure fluctuations of the ink recovered from the printing head to the ink tank;

an ink flow-out pipe path provided between the printing head and the ink tank; and a flow-out pump connected to the ink flow-in pipe for recovering the ink from the printing head to the ink tank.

* * * * *